US010370065B2

(12) United States Patent
Barrett

(10) Patent No.: US 10,370,065 B2
(45) Date of Patent: Aug. 6, 2019

(54) WATERCRAFT ANCHORS

(71) Applicant: Joe Barrett, Auburn, WA (US)

(72) Inventor: Joe Barrett, Auburn, WA (US)

( * ) Notice: Subject to any disclaimer, the term of this patent is extended or adjusted under 35 U.S.C. 154(b) by 0 days.

(21) Appl. No.: 16/029,336

(22) Filed: Jul. 6, 2018

(65) Prior Publication Data

US 2019/0016417 A1 Jan. 17, 2019

Related U.S. Application Data

(60) Provisional application No. 62/532,015, filed on Jul. 13, 2017.

(51) Int. Cl.
*B63B 21/44* (2006.01)
*B63B 21/29* (2006.01)

(52) U.S. Cl.
CPC ..... *B63B 21/44* (2013.01); *B63B 21/29* (2013.01)

(58) Field of Classification Search
CPC ..... B63B 21/44; B63B 21/29
See application file for complete search history.

(56) References Cited

U.S. PATENT DOCUMENTS 4,098,217 A * 7/1978 Altman ..... B63B 21/44 114/299
4,134,355 A * 1/1979 Carruthers ..... B63B 21/38 114/297
4,676,184 A * 6/1987 Ogg ..... B63B 21/44 114/294
4,781,142 A * 11/1988 Cheung ..... B63B 21/44 114/301
4,798,159 A * 1/1989 Taylor ..... B63B 21/44 114/295
4,958,586 A * 9/1990 Stupakis ..... B63B 21/243 114/297
6,038,996 A * 3/2000 Giles ..... B63B 21/24 114/297
6,145,464 A * 11/2000 Machida ..... B63B 21/44 114/304
7,886,681 B2 * 2/2011 Weinstein ..... B63B 21/46 114/299
8,485,117 B2 * 7/2013 Weinstein ..... B63B 21/46 114/299
9,764,798 B1 * 9/2017 Voelker ..... B63B 21/34
10,118,672 B2 * 11/2018 Fitch ..... B63B 21/40
(Continued)

*Primary Examiner* — S. Joseph Morano
*Assistant Examiner* — Jovon E Hayes
(74) *Attorney, Agent, or Firm* — Mohr Intellectual Property Law Solutions, PC

(57) ABSTRACT

A method, system, apparatus, and/or device for anchoring a watercraft. The method, system, apparatus, and/or device may include a head and a scissoring shank. The head may be configured to dig into a seafloor of a body of water to restrict the movement of a watercraft. The scissoring shank may be connected to the head. The scissoring shank may include a pivot member connected to the head. The scissoring shank may include a first shank arm connected to the head by the pivot member. The scissoring shank may include a second shank arm connected to the head. The scissoring shank may include a first hole extending through the first shank arm and the second shank arm. The scissoring shank may include a shear member inserted into the first hole. The shear member may restrict the first shank arm from rotating about the pivot member.

20 Claims, 6 Drawing Sheets

(56) References Cited

U.S. PATENT DOCUMENTS

| | | | | |
|---|---|---|---|---|
| 2006/0107886 | A1* | 5/2006 | Zimmerman | B63B 21/243 114/294 |
| 2019/0016417 | A1* | 1/2019 | Barrett | B63B 21/44 |

* cited by examiner

WATERCRAFT ANCHORS

CROSS-REFERENCE TO RELATED APPLICATION

This application claims the benefit of U.S. Provisional Application No. 62/532,015, filed Jul. 13, 2017.

BACKGROUND

Anchors are used to secure various watercrafts in fixed locations and prevent the watercrafts from drifting in currents or rough waters. When a watercraft is anchored offshore, the anchor may be a relatively heavy object with a tether that is fastened to a body of the watercraft. The anchor may be placed overboard of the watercraft so that the heavy object sinks to a bottom of a seabed or floor bed below the watercraft. The anchor may be curved and/or include hooks, shanks, barbs, or flukes that may dig into a surface of the seabed or floor bed to secure the watercraft in a stationary location.

DETAILED DESCRIPTION

Figure 1:
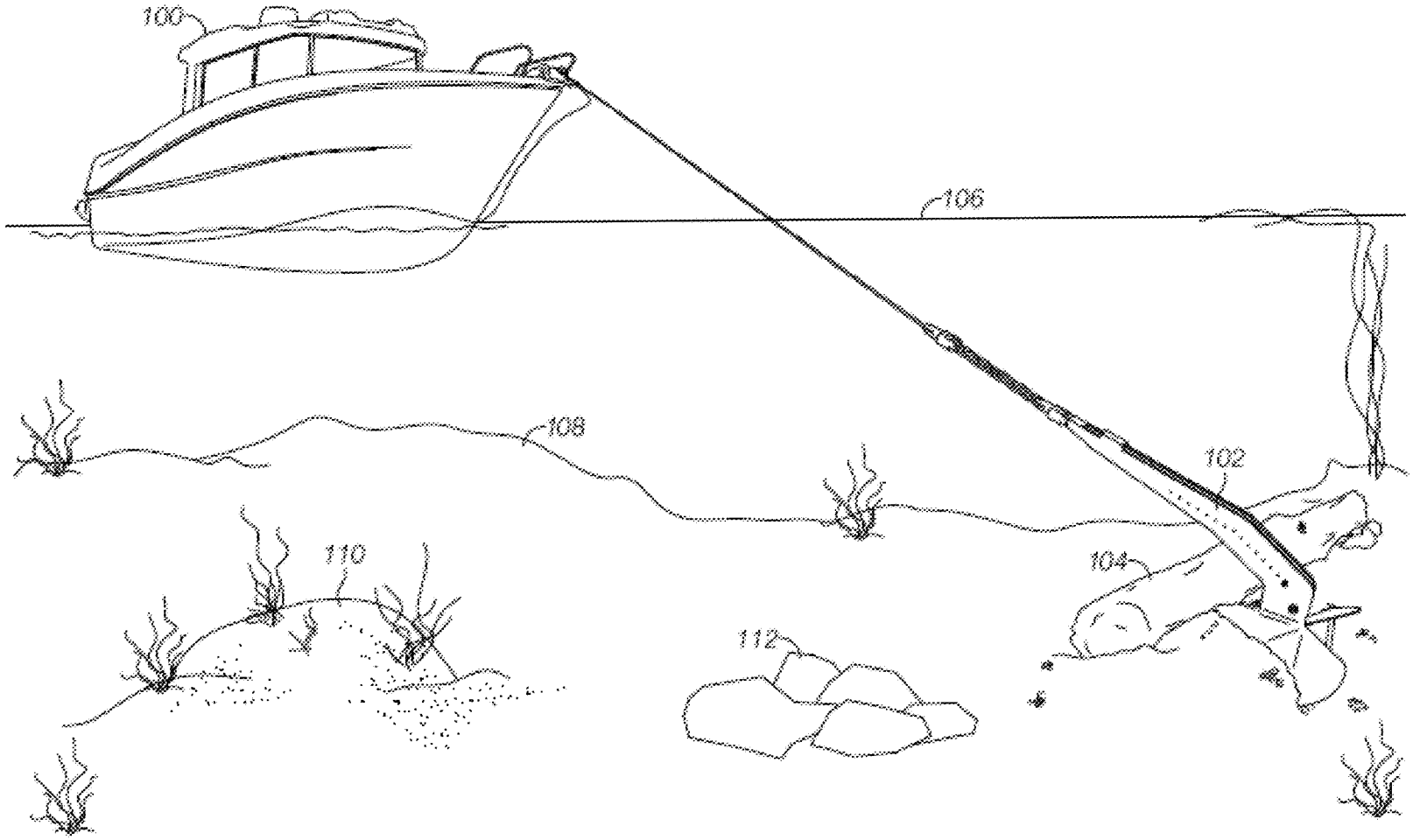
FIG. 1 illustrates a watercraft in a body of water with an anchor stuck under an object 104, according to an embodiment.

The disclosed watercraft anchors will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of watercraft anchors examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

A conventional anchor are used to secure a watercraft in a stationary or fixed location and prevent the watercraft from drifting in a current or rough waters. The conventional anchor may include a relatively heavy object connected to a tether. The tether may be fastened to a body of the watercraft and then the anchor may be placed overboard of the watercraft. The heavy object may sink to a bottom of a seabed or floor bed below the watercraft. The heavy object of the anchor may be curved and/or include hooks, shanks, barbs, or flukes that may dig into a surface of the seabed or floor bed to secure the watercraft in the stationary or fixed location.

The conventional anchor may temporarily engage with the seabed or floor bed when deployed to secure the position of the watercraft. When a user of the watercraft desires to move the watercraft, the individual may disengage the anchor from the seabed or floor bed and hoist the anchor back into the watercraft. To disengage a conventional anchor, an individual may pull the anchor up by hand or use a winch to lift the anchor. However, conventional anchors are prone to snagging on rocks, plant matter, and/or other objects along the seabed or floor bed. For example, because a conventional anchor is curved and/or includes hooks, shanks, barbs, or flukes that may dig into a surface of the seabed or floor bed, the anchor may catch on the objects and become stuck as an individual attempts to hoist it into the watercraft. When the conventional anchor becomes stuck on the seabed or floor bed and cannot be hoisted, the individual may attempt to free the anchor by applying additional pulling force to the anchor or attempting to pull the anchor backward to dislodge and free the anchor. Pulling the anchor with the additional force and/or pulling the anchor backward may cause the anchor to dig into the object further, causing the anchor to become even more stuck on the object. Additionally, pulling the anchor with additional force and/or maneuvering the watercraft while the anchor is stuck to the object may pose a safety hazard to the watercraft. For example, as additional force is applied to the anchor, the force may pull the watercraft downward toward the water and increase a likelihood of the watercraft taking on water, flooding, or capsizing. Additionally, if the tether of the anchor breaks or snaps due to the additional force, the tether may recoil and hit the watercraft and/or an individual onboard the watercraft thereby damaging the watercraft and/or injuring the individual. To avoid the safety hazards and risk to the watercraft and/or individual, an individual may cut the tether of the anchor to free the watercraft from the anchor. The anchor is then abandoned.

Implementations of the disclosure address the above-mentioned deficiencies and other deficiencies by providing a method, system, device, and/or apparatus to anchor watercrafts and be dislodged from objects when the anchor becomes stuck. The anchor may include a head, a pivot member, a shear member, and a scissoring shank. The anchor may be configured to be a self-extracting anchor that may automatically or with minimal effort be dislodged or extracted from an object that the anchor has become stuck on. An advantage of the anchor may be to reduce the time and effort for dislodging a stuck anchor. Another advantage of the anchor may be to provide an anchor that does not pose a safety concern to the watercraft and/or an individual on the watercraft as the anchor is dislodged. Another advantage of the anchor may be that an individual may easily dislodge and extract the anchor from the object rather than abandoning a stuck anchor.

FIG. 1 illustrates a watercraft 100 in a body of water with an anchor 102 stuck under an object 104, according to an embodiment. In one embodiment, the anchor 102 may initially be deployed from the watercraft 100 to secure the watercraft 100 in a fixed and stationary location in the water 106. To secure the watercraft 100 in the fixed and stationary location, the anchor 102, may be shaped to engage and become temporarily secured to the seafloor 108. For example, the anchor 102 may be curved and/or include hooks, shanks, barbs, flukes, and so forth that may dig into the bed of the seafloor 108. When an operator of the watercraft 100 desires to move the watercraft 100 from the fixed and stationary location, the operator may disengage the anchor 102 from the seafloor 108. As the seafloor 108 is along the bottom of a body of water (such as a lake, a reservoir, an ocean, or a sear), the seafloor 108 may include various objects 104, 110, 112, and so forth. To disengage the anchor 102 from seafloor 108, the operator of the watercraft 100 may pull the anchor 102 upward using a winch or by hand. As the operator pulls the anchor 102 upward, the anchor 102 may become stuck on or lodged against the object 104. The object 104 may be a rock, a log, plant material, garbage, or another object on the surface of the seafloor 108. When the anchor 102 becomes stuck on or lodged against the object 104, the anchor 102 may self-extract to become dislodged so that the anchor 102 may be retrieved and the watercraft 100 may be moved, as discussed below.

Figure 2:
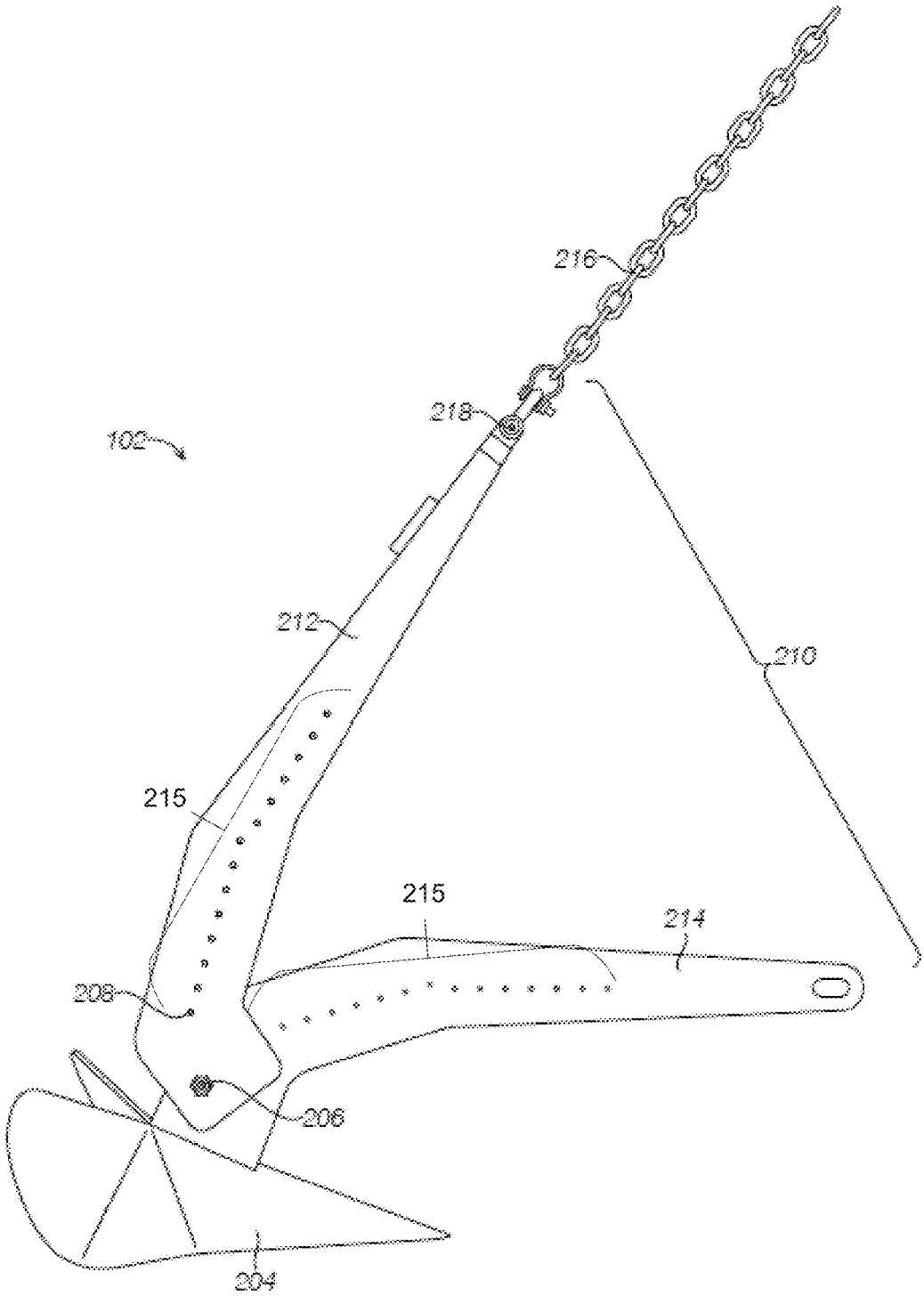
FIG. 2 illustrates the anchor in FIG. 1, according to an embodiment.

FIG. 2 illustrates the anchor 102 in FIG. 1, according to an embodiment. Some of the features in FIG. 2 are the same or similar to some of the features in FIG. 1 as noted by same reference numbers, unless expressly described otherwise. As discussed above, the anchor 102 may be a self-extracting anchor that may extract itself or be extracted by an individual with minimal additional force or effort exerted by the individual. In one embodiment, the self-extracting anchor may be an anchor that may be stuck on or lodged against object 104 and extracted by pulled upwardly on the anchor with the same motion and action as an anchor that is not stuck on or lodged against object 104. In another embodiment, the self-extracting anchor may be an anchor that may be stuck on or lodged against object 104 and extracted by pulled upwardly on the anchor with the same motion and action but with a great amount of force that an anchor that is not stuck on or lodged against object 104. In another embodiment, the self-extracting anchor may be an anchor that may be stuck on or lodged against object 104 and extracted by pulled upwardly on the anchor with the backward motion and action in comparison to a forward motion and action of an anchor that is not stuck on or lodged against object 104.

The anchor 102 may include a head 204, a pivot member 206, a shear member 208, and a scissoring shank 210. The scissoring shank 210 may include a first shank arm 212 and a second shank arm 214. In one embodiment, a connector 218 may connect a tether 216 to the first shank arm 212. The connector 218 may be a loop, a chain connector, a link, a spring link, a quick link, a carabiner, a clamp, a screw eye, and so forth. The tether 216 may be a chain, a cable, a rope, a cord, and so forth. The head 204 and/or scissoring shank 210 may be a metal material or a metal alloy material (such as steel, stainless steel, aluminum, and so forth), a plastic material, a wood material, a composite material, and so forth. The head 204 may be different shapes, such as a plow head, a claw head, a ray head, a wing head, a lightweight type (LWT) head, a spade head, a hook, and so forth. In one embodiment, the shear member 208 may be a shear pin, a peg, a stopper, a rod, a plate, and so forth. The shear member 208 may be a plastic material, a metal material, a metal alloy material, a wood material, a composite material, and so forth.

In one embodiment, the first shank arm 212 and the second shank arm 214 may be joined together by the pivot member 206 and the shear member 208. When intact, the shear member 208 may keep the first shank arm 212 and the second shank arm 214 together and prevent the first shank arm 212 and/or the second shank arm 214 from swinging open or separating. For example, when the shear member 208 is intact, the first shank arm 212 may overlap or overlay on top of the second shank arm 214 to function as a one-piece shank with a single shank arm. In one embodiment, the first shank arm 212 may be longer than the second shank arm 214 and the first shank arm 212 may include a hollow section or channel that may extend over a portion of the second shank arm 214. In another embodiment, the first shank arm 212 may be the same length or shorter than the second shank arm 214 and the first shank arm 212 may include a hollow section or channel that may extend over a portion of the second shank arm 214.

As discussed above, when the head 204 of the anchor 102 becomes snagged on debris along the seabed, attempting to hoist the anchor 102 with the first shank arm 212 and the second shank arm 214 in the closed position as a single shank arm may apply an increased amount of tension to the tether 216 and pulls the anchor 102. Further into the debris. As discussed below, when the anchor 102 become stocks on or lodged against an object, the first shank arm 212 and the second shank arm 214 of the anchor 102 may be configured to reverse itself from the object by the first shank arm 212 swinging away from the second shank arm 214. For example, when the anchor 102 becomes stuck on or lodged against an object and a first threshold amount of force is applied tension to tether 216, at least a portion of the force may be applied to the shear member 208 via the first shank arm 212 and the second shank arm 214. When the amount of force applied to the shear member 208 exceeds a second threshold amount, the shear member 208 may shear to allow the first shank arm 212 to swing away from the second shank arm 214. In one example, the portion of the first shank arm 212 between the connector 218 and the shear member 208 may act as a lever arm that magnifies a shearing force on the shear member 208.

The second threshold amount of force may vary based on the location of the shear member 208 along the first shank arm 212 and the second shank arm 214 and the type of shear member 208. In one example, depending on the characteristics of the watercraft, the anchor 102 is being used for, one or more characteristics of the shear member 208 may vary. The characteristics of the shear member 208 may include a type of material of the shear member 208 (such as metal, metal alloy, plastic, and so forth), a thickness of the shear member 208, a density or material strength of the shear member 208, and so forth. The characteristics of the watercraft may include a shape of the watercraft, a size of the watercraft, a location the tether 216 is attached to the watercraft, the horsepower of the watercraft, a buoyancy level of the watercraft (i.e. how high the watercraft sits in the water), a length of the watercraft, and so forth. In another example, which hole of the set of holes 215 that the shear member 208 may be inserted into may vary based on the characteristics of the watercraft. In one example, for a watercraft that is 33 to 42 feet in length, the anchor 102 may include holes 215 with 14 positions, where the hole 215 nearest the tether 216 may apply 500 pounds (lbs) of shearing force to the shear member 208 and the hole 215 farthest from the tether 216 may apply 1800 lbs of shearing force to the shear member 208. Depending on the characteristics of the watercraft, a user may insert the shear member 208 at different holes 215 in order to shear the shear member 208. In one example, for a relatively small watercraft, the threshold amount of force to shear the shear member 208 may be 500 lbs and the user may insert the shear member 208 in the hole 215 nearest the tether 216. In another example, for a relatively large watercraft, the threshold amount of force to shear the shear member 208 may be 1800 lbs and the user may insert the shear member 208 in the hole 215 farthest from the tether 216.

Figure 3A:
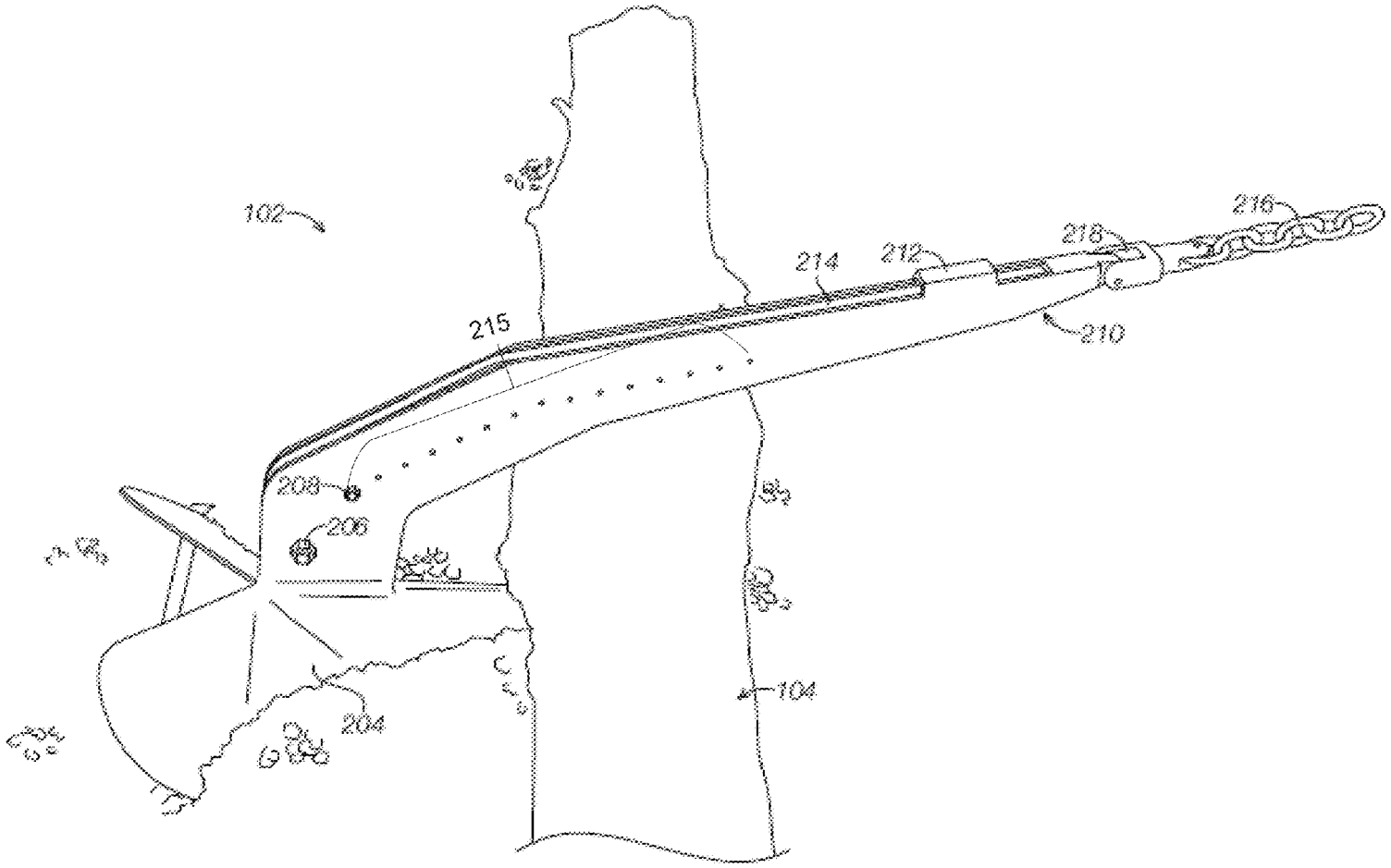
FIG. 3A illustrates the anchor in a closed position lodged against the object of FIG. 1, according to an embodiment.

FIG. 3A illustrates the anchor 102 in a closed position lodged against the object 104 of FIG. 1, according to an embodiment. Some of the features in FIG. 3A are the same or similar to some of the features in FIGS. 1 and 2 as noted by same reference numbers, unless expressly described otherwise. As discussed above, when the anchor 102 is deployed to hold a watercraft in a stationary and fixed location, the first shank arm 212 and the second shank arm 214 are in a closed position where the shear member 208 is intact and the first shank arm 212 overlaps or overlays on top of the second shank arm 214. In the closed position, the first shank arm 212 and the second shank arm 214 may function as a one-piece shank with a single shank arm. As the anchor 102 is being retracted from the seafloor so that the watercraft can move about, the anchor 102 may become lodged against the object 104 in the closed position. As force is continued to be applied to the tether 216 to retract the anchor 102 that is lodged against the object 104, at least a portion of the force is transferred to the shear member 208. As discussed above, when a threshold amount of force is applied to the shear member 208, the shear member 208 may shear and allow the first shank arm 212 to swing away from the second shank arm 214.

In one embodiment, the first shank arm 212 and the second shank arm 214 may include a single hole 215 extending through the first shank arm 212 and the second shank arm 214 that is configured to receive the shear member 208. In another embodiment, the first shank arm 212 and the second shank arm 214 may include a set of holes 215 extending through at least a portion of the first shank arm 212 and/or the second shank arm 214. The set of holes 215 may be configured to receive the shear member 208. For example, when the first shank arm 212 and the second shank arm 214 are collapsed together, the holes of the set of holes 215 may line up to allow the shear member 208 to be inserted into any one of the holes in the set of holes 215.

The user of the anchor 102 may insert the shear member 208 into one of the holes of the set of holes 215 based on the amount of force need to shear the shear member 208 when the anchor 102 becomes stuck on or lodged against the object 104. By moving the position of the shear member 208 between different holes of the set of holes 215 in the first shank arm 212 and the second shank arm 214, a user may adjust an amount of force transferred from the first shank arm 212 and/or the second shank arm 214 to the shear member 208. For example, the first shank arm 212 may act as a lever arm relative to the second shank arm 214 so that as a pulling force is applied to the tether 216, the first shank arm 212 acts as a lever to apply force to the shear member 208.

By changing which hole 215 of the set of holes 215 the shear member 208 is inserted into, an effective length of that lever changes and the threshold amount of force on the tether 216 that to shear the shear member 208 may increase or decreased. In one example, when the shear member 208 is inserted into a hole 215 closer to the connector 218, the effective length of the lever is shortened and the amount of force transferred from the first shank arm 212 and the second shank arm 214 is decreased. In another example, when the shear member 208 is inserted into a hole 215 farther from the connector 218, the effective length of the lever is increased and the amount of force transferred from the first shank arm 212 and the second shank arm 214 is increased.

In one embodiment, the anchor 102 may include a single shear member 208 inserted into the single hole in the set of holes 215. In another embodiment, the anchor 102 may include multiple shear members 208 that may be inserted into different holes of the set of holes 215. When multiple shear members 208 are inserted into the different holes 215, that threshold amount of force to shear the shear members 208 may be further adjusted. For example, the multiple shear members 208 may allow an individual to more precisely select the threshold amount of force to shear the shear members 208 and allow the first shank arm 212 to swing away from the second shank arm 214.

Figure 3B:
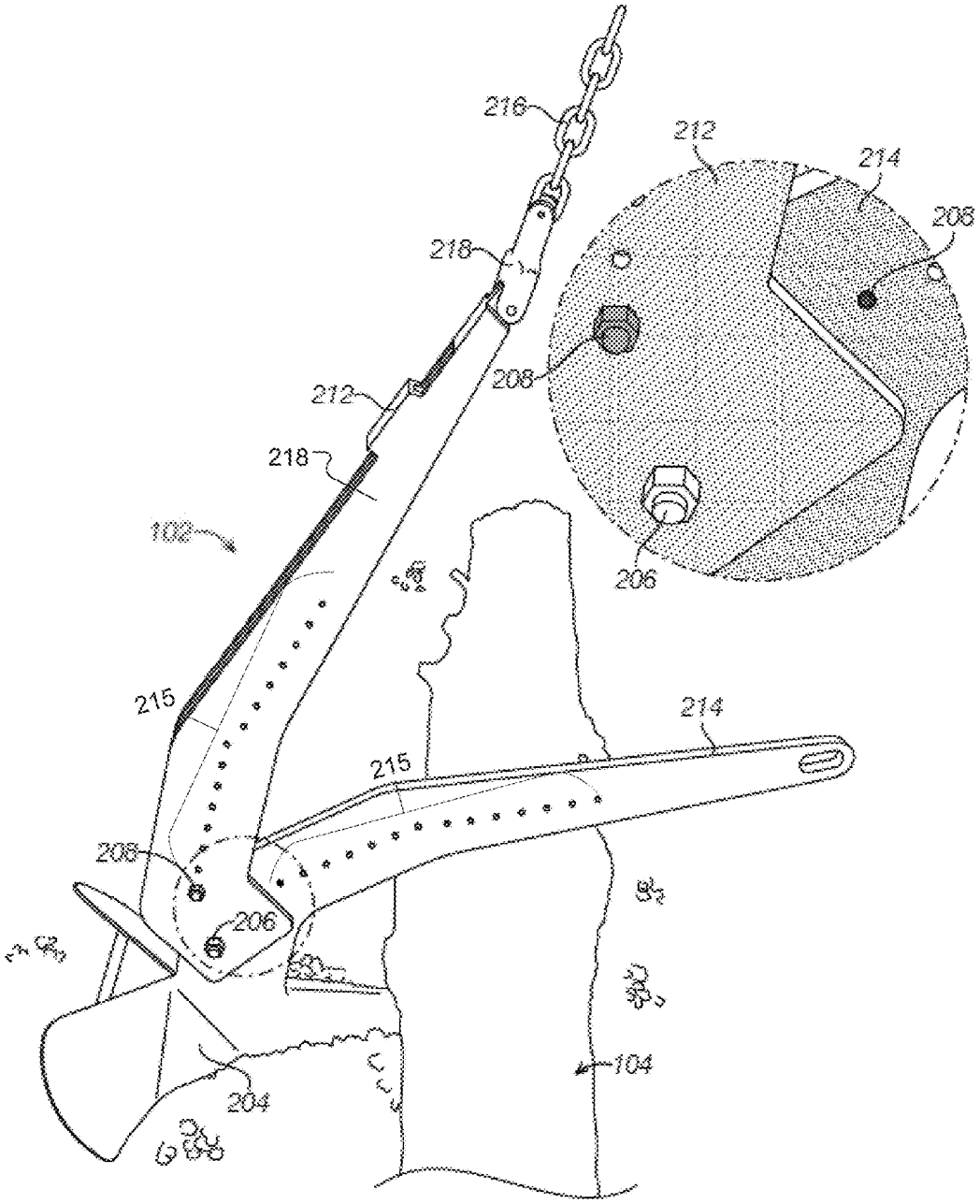
FIG. 3B illustrates the anchor in an open position lodged against the object of FIG. 1, according to an embodiment.

FIG. 3B illustrates the anchor 102 in an open position when lodged against the object 104 of FIG. 1, according to an embodiment. Some of the features in FIG. 3B are the same or similar to some of the features in FIGS. 1-3A as noted by same reference numbers, unless expressly described otherwise. As discussed above, when a threshold amount of force is applied to the shear member 208, the shear member 208 may shear and allow the first shank arm 212 to swing away from the second shank arm 214. The first shank arm 212 may rotate about the pivot member 206 relative to the second shank arm 214. For example, the second shank arm 214 may be a stationary or fixed member that is connected to the head 204 and does not rotate. The pivot member 206 may be a pin, a shaft, a rod, and so forth that the first shank arm 212 may rotate on to swing from the closed position where the first shank arm 212 overlays the second shank arm 214 to the open position where the first shank arm 212 swings away from the second shank arm 214 once the shear member 208 has sheared. As the first shank arm 212 rotates away from the second shank arm 214, a distance between the first shank arm 212 and the second shank arm 214 may increase.

Figure 3C:
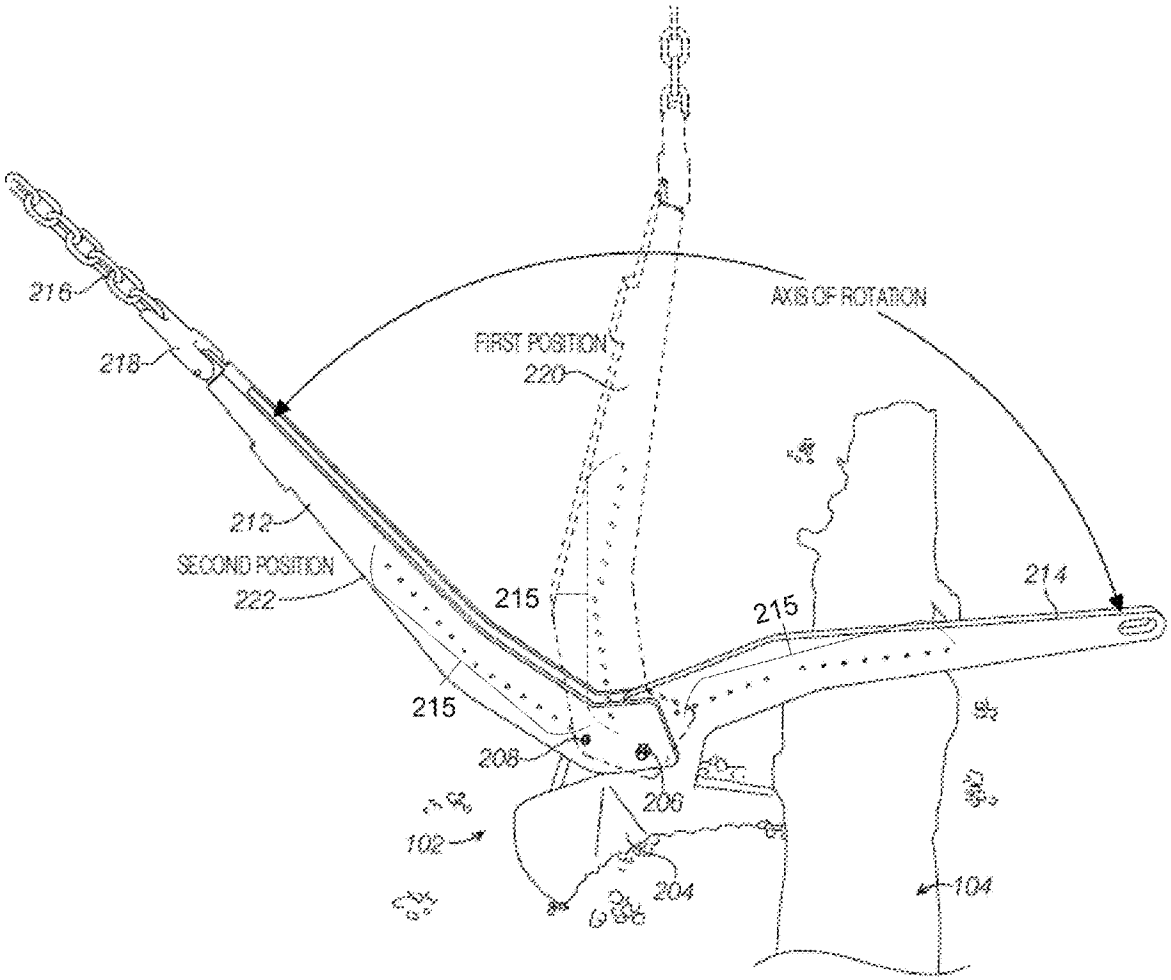
FIG. 3C illustrates the first shank arm opening to a first position or a second position, according to an embodiment.

FIG. 3C illustrates the first shank arm 212 opening to a first position 220 or a second position 222, according to an embodiment. Some of the features in FIG. 3C are the same or similar to some of the features in FIGS. 1-3B as noted by same reference numbers, unless expressly described otherwise. As discussed above, when the shear member 208 shears, it allows the first shank arm 212 to swing away from the second shank arm 214. In one embodiment, the first shank arm 212 may rotate along an axis relative to the second shank arm 214. In one example, the first shank arm 212 and the second shank arm may extend from the head 204 along the same plane. The first shank arm 212 may then rotate about an axis along that plane, such as a. Y-axis of a vertical plane. In another example, the first shank arm 212 may rotate about the axis within a range of degrees. For example, as the second shank arm 214 is fixed to the head 204 it may not rotate and the first shank arm 212 may rotate within a range of 180 degrees away from the second shank arm 214.

In one embodiment, the degree that the first shank arm 212 rotates may be based on an angle that the tether 216 may be pulled relative to the second shank arm 214. In one example, when a watercraft is located above the anchor 102 and the tethered is pulled upward relative to the second shank arm 214, the first shank arm 212 may rotate to the first position 220. In one example, the first position 220 may be approximately 90 degrees relative to the second shank arm 214. In another example, the first position 220 may be between 1 degree and 120 degrees relative to the second shank arm 214. When the first shank arm 212 is pulled into the first position 220, the second shank arm 214 and the head 204 may be pulled backward and upward relative to their current position.

In one embodiment, as the second shank arm 214 and the head 204 are pulled backward and upward by the first shank arm 212, the anchor 102 may be dislodged from the object 104 and be freed to be pulled to the watercraft. In another embodiment, when the angle of the first position 220 is insufficient to dislodge the anchor from the object 104, a position of the first shank arm 212 may be switched from the first position 220 to a second position 222. For example, when the upward and backward force on the anchor 102 at the first position is insufficient to dislodge the anchor 102, an operator of the watercraft may move the watercraft to a position behind the anchor 102.

When the watercraft is behind the anchor 102 and the tether 216 is pulled on, the first shank arm 212 may switch from the first position 220 to the second position 222. In one example, the second position 222 may be approximately 180 degrees relative to the second shank arm 214. In another embodiment, the second position 222 may be between 121 degree and 180 degrees relative to the second shank arm 214. The second position 222 may enable an operator to pull backward on the anchor 102 with additional force to dislodge the anchor 102. For example, in the first position 220 a pulling force on the first shank arm 212 may be primarily an upward force and in the second position 222 the pulling force on the first shank arm 212 may be primarily a backward force. The backward force may be a pulling force that is in a direction that is opposite to the pulling force direction when the first shank arm 212 and the second shank arm 214 are in the closed position. The degrees and degree ranges of the first position 220 and the second position 222 are not intended to be limiting. For example, the degrees and degree ranges of the first position 220 and the second position 222 may be different or vary based on the configuration of the anchor 102, the type of watercraft, the type of object 104, the shape of the head 204, and so forth. In another example, the first shank arm 212 may be rotated between multiple positions.

The first position 220 and the second position 222 may provide an operator different angles to apply the pulling force on the anchor 102 by rotating the first shank arm 212 in order for the operator to dislodge the anchor 102 from the object 104. In one embodiment, the anchor 102 may be a self-extracting anchor because the operator and watercraft may remain in the same position and apply the same force to the first shank arm 212 both when the first shank arm 212 and the second shank arm 214 are in the closed position and when the first shank arm 212 is in the first position 220. In another embodiment, the operator may exert a minimal amount of effort to reposition the watercraft behind the anchor and pull on the first shank arm 212 so that the first shank arm 212 will switch to the second position.

Figure 3D:
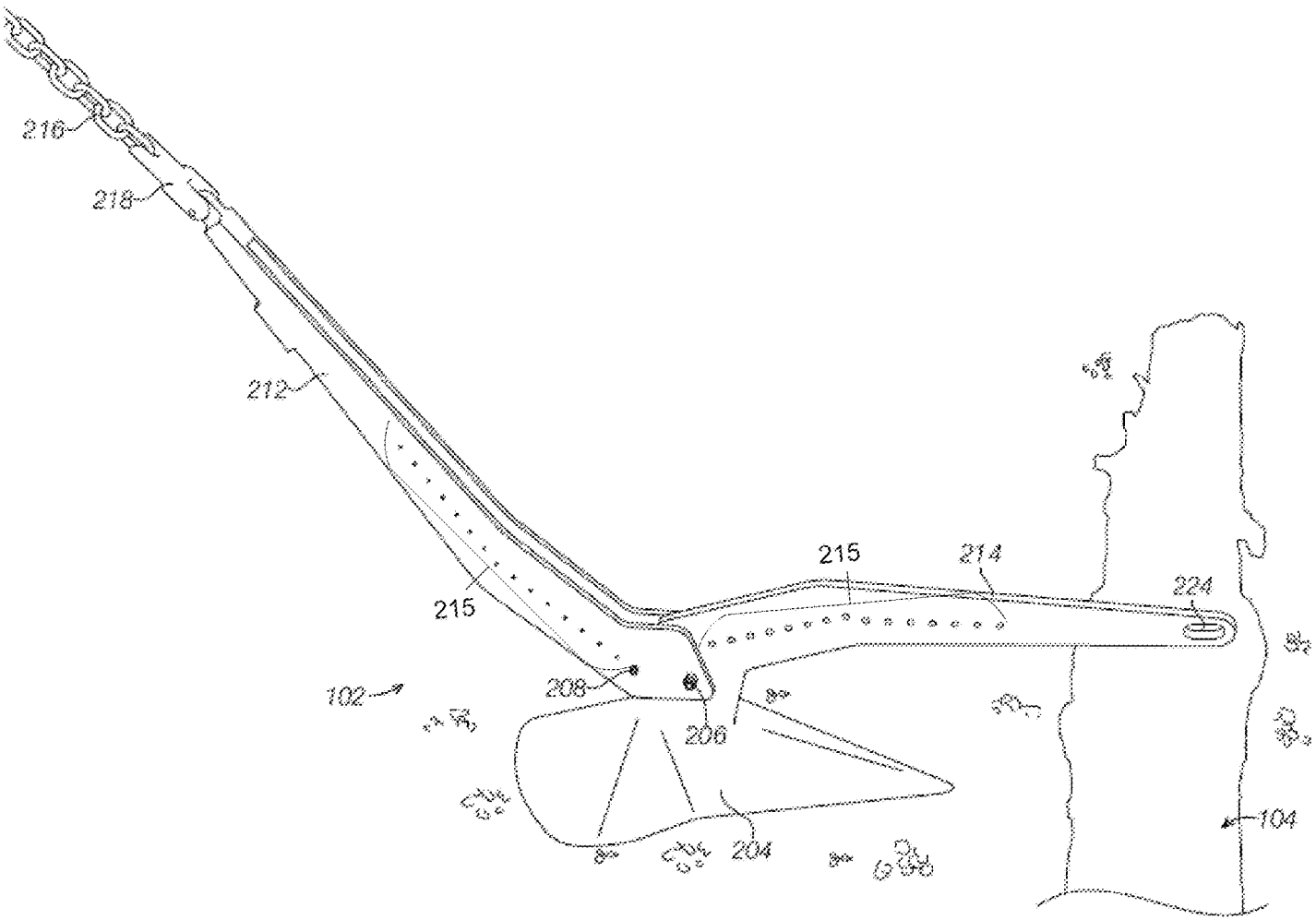
FIG. 3D illustrates the anchor that is dislodged from the object, according to an embodiment.

FIG. 3D illustrates the anchor 102 that is dislodged from the object 104, according to an embodiment. Some of the features in FIG. 3D are the same or similar to some of the features in FIGS. 1-3C as noted by same reference numbers, unless expressly described otherwise. As discussed above, the anchor 102 may be dislodged from the object 104 when pulling force is applied to the first shank arm 212. Once the anchor 102 is dislodged from the object 104, the anchor 102 may be hoisted up to the watercraft so that the watercraft may freely move about to different locations without the anchor 102 securing it to the seafloor.

When the anchor 102 is hoisted back to the watercraft, a replacement shear member may be inserted into the hole 215 extending through the first shank arm 212 and the second shank arm 214, as discussed above. Once the replacement shear member has been replaced, the anchor 102 may be redeployed and reused to secure the watercraft at a later point in time.

In one embodiment, the second shank arm 214 may include a connection point 224. The tether may be attached to the connection point 224 directly and/or to the connector 218 connected to the connection point 224 so that the first shank arm 212 may not rotate and the anchor 102 may be used as a conventional anchor. In one embodiment, the pivot member 206, the shear member 208, and the first shank arm 212 may be removed from the anchor 102 so that the anchor 102 does not include the scissoring shank 210 and the anchor 102 may be used a conventional anchor.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. An apparatus, comprising: a head configured to dig into a seafloor of a body of water to restrict a movement of a watercraft; a scissoring shank connected to the head, wherein the scissoring shank comprises: a pivot member connected to the head; a first shank arm connected to the head by the pivot member; a second shank arm connected to the head, wherein: the first shank arm is configured to rotate about the pivot member along a vertical plane relative to the second shank arm, wherein: when the first shank arm rotates to a closed position, the first shank arm overlaps the second shank arm; and when the first shank arm rotates to an open position, the first shank arm is a distance from the second shank arm along the vertical plane; a first hole extending through the first shank arm and the second shank arm; and a shear member inserted into the first hole, the shear member restricting the first shank arm to the closed position, wherein when a threshold amount of shearing force is applied to the shear member, the shear member shears to allow the first shank arm to pivot to the open position; and a connector connected to an end of the first shank arm, wherein: the connector is configured to attach to a tether that is connected to the watercraft; and the connector is configured to transfer force from the tether to the shear member via the first shank arm.

2. The apparatus of claim 1, further comprising the tether connected to the watercraft, wherein the head is lodged against an object along the seafloor.

3. The apparatus of claim 2, wherein when pulling force is applied to the tether as the head is lodged against the object, the threshold amount of shearing force is applied to the shear member to switch the first shank arm from the closed position to the open position.

4. The apparatus of claim 3, wherein when the first shank arm is in the open position, the pulling force from the tether dislodges the head from the object.

5. The apparatus of claim 1, wherein the threshold amount of shearing force to shear the shear member is between 500 pounds of force and 1800 pounds of force.

6. The apparatus of claim 1, wherein the threshold amount of shearing force to shear the shear member is based on a characteristic of the watercraft.

7. The apparatus of claim 6, wherein the characteristic of the watercraft comprises at least one of:

a shape of the watercraft;

a size of the watercraft;

a location the tether is attached to the watercraft;

a horsepower of the watercraft;

a buoyancy level of the watercraft; or a length of the watercraft.

8. The apparatus of claim 1, wherein the scissoring shank includes a second hole 215 extending through the first shank arm and the second shank arm, the second hole being configured to receive the shear member.

9. The apparatus of claim 8, wherein the threshold amount of shearing force to shear the shear member at the first hole is different than the threshold amount of force to shear the shear member at the second hole.

10. The apparatus of claim 1, wherein the threshold amount of shearing force to shear the shear member is based on a characteristic of the shear member.

11. The apparatus of claim 10, wherein the characteristic of the shear member comprises at least one of:

a type of material of the shear member;

a thickness of the shear member;

a density of the shear member; or a material strength of the shear member.

12. A device, comprising: a head configured to dig into a seafloor of a body of water to restrict a movement of a watercraft; and a scissoring shank connected to the head, wherein the scissoring shank comprises: a pivot member connected to the head; a first shank arm connected to the head by the pivot member; a second shank arm connected to the head, wherein: a first hole extending through the first shank arm and the second shank arm; and a shear member inserted into the first hole, the shear member restricting the first shank arm from rotating about the pivot member.

13. The device of claim 12, wherein the first shank arm is configured to rotate about the pivot member along a vertical plane relative to the second shank arm, wherein:

when the first shank arm rotates to a closed position, the first shank arm overlaps the second shank arm; and when the first shank arm rotates to an open position, the first shank arm is a distance from the second shank arm along the vertical plane.

14. The device of claim 13, wherein when a threshold amount of shearing force is applied to the shear member, the shear member shears to allow the first shank arm to pivot to the open position.

15. The device of claim 12, further comprising a connector connected to an end of the first shank arm, wherein:

the connector is configured to attach to a tether that is connected to the watercraft; and the connector is configured to transfer force from the tether to the shear member via the first shank arm.

16. The device of claim 12, wherein the head is a plow head, a claw head, a ray head, a wing head, a lightweight type (LWT) head, a spade head, or a hook.

17. An apparatus, comprising: a head configured to restrict a movement of a watercraft; and a scissoring shank connected to the head, wherein the scissoring shank comprises: a pivot member connected to the head; a first shank arm connected to the head by the pivot member, the first shank arm being configured to rotate about the pivot member; a second shank arm connected to the head, wherein: a first hole extending through the first shank arm and the second shank arm at a first location; and a second hole extending through the first shank arm and the second shank arm at a second location.

18. The apparatus of claim 17, further comprising:

a first shear member inserted into the first hole, the first shear member restricting the first shank arm from rotating about the pivot member; and a second shear member inserted into the second hole, the second shear member restricting the first shank arm from rotating about the pivot member.

19. The apparatus of claim 17, wherein the head and the scissoring shank are lodged around an object along a seafloor below the watercraft.

20. The apparatus of claim 17, wherein the head is lodged below an object along a seafloor below the watercraft and the scissoring shank is lodged above the object.

* * * * *